US005133543A

United States Patent [19]

Eitel et al.

[11] Patent Number: 5,133,543

[45] Date of Patent: Jul. 28, 1992

[54] SHEET CONVEYING APPARATUS

[75] Inventors: Johann E. Eitel, Thüngen; Erich G. Wieland, Würzburg, both of Fed. Rep. of Germany

[73] Assignee: Koenig & Bauer Aktiengessellschaft, Fed. Rep. of Germany

[21] Appl. No.: 686,430

[22] Filed: Apr. 17, 1991

[30] Foreign Application Priority Data

Apr. 26, 1990 [DE] Fed. Rep. of Germany ..... 4013302

[51] Int. Cl.[5] ..... B65H 5/02

[52] U.S. Cl. ..... 271/276; 271/96; 271/197

[58] Field of Search ..... 271/151, 197, 216, 275, 271/276, 6, 7, 12, 3.1, 96

[56] References Cited

U.S. PATENT DOCUMENTS

| | | | |
|---|---|---|---|
| 3,522,943 | 8/1970 | Swanson | 271/6 |
| 3,684,277 | 8/1972 | Buschmann | 271/197 X |
| 3,754,826 | 8/1973 | Kobayashi et al. | 271/275 X |
| 4,627,608 | 12/1986 | Harms | 271/96 X |
| 4,900,297 | 2/1990 | Frost et al. | 271/197 X |

FOREIGN PATENT DOCUMENTS

| | | | |
|---|---|---|---|
| 1202118 | 9/1965 | Fed. Rep. of Germany | 271/197 |
| 2533232 | 2/1977 | Fed. Rep. of Germany | 271/276 |
| 3138481 | 6/1983 | Fed. Rep. of Germany . | |
| 3838078 | 6/1989 | Fed. Rep. of Germany . | |
| 1293893 | 6/1961 | France | 271/197 |
| 131649 | 8/1982 | Japan | 271/275 |
| 167848 | 8/1985 | Japan | 271/197 |

OTHER PUBLICATIONS

Estabrooks et al, "Vacuum Belt Transporter", IBM Tech. Bulletin, vol. 23, No. 6, p. 2221, Nov. 1980.

*Primary Examiner*—Robert P. Olszewski
*Assistant Examiner*—Boris Milef
*Attorney, Agent, or Firm*—Jones, Tullar & Cooper

[57] ABSTRACT

A sheet conveying apparatus uses spaced, serially arranged suction chambers to provide suction to overrunning conveying belts. The belts are divergent with respect to each other in the direction of sheet transport to effect a lateral stretching of the conveyed sheets. The conveying belts are slidably supported on an upper surface of the conveying table and may have their speeds individually varied.

8 Claims, 4 Drawing Sheets

SHEET CONVEYING APPARATUS

FIELD OF THE INVENTION

The present invention is directed generally to a sheet conveying apparatus. More particularly the present invention is directed to a device for conveying a shingled stream of sheets. Most specifically, the present invention is directed to a device for conveying a shingled stream of sheets to a sheet handling machine. A pair of spaced sheet conveying belts are positioned generally parallel to each other and extend along the top of a sheet conveying table. The two sheet conveying belts overlie spaced suction chambers that are provided with suction ports. The belts themselves also have suction openings so that the sheets carried by the belts are held on the surfaces of the belts by vacuum. Suitable controls are provided to regulate the amount of suction exerted on the sheets through each of the suction chambers. In addition, the belts may diverge in the direction of sheet transport to stretch the sheets.

DESCRIPTION OF THE PRIOR ART

It is generally known in the art to convey shingled streams of sheets from one area to another. The sheets are often supplied to the conveying device from a sheet stack and are delivered to front register lays of a subsequent sheet handling machine. A suction or negative pressure is typically used to hold the sheets in place in the shingled stream during conveying of the sheets from one location to the next.

One such shingled stream conveying device is shown in the Xerox Disclosure Journal, Volume 4, Number 2, of Mar./Apr. 1979. This device utilizes a single suction chamber which is kept at a negative pressure. The suction chamber has a plurality of bore holes in its upper surface and endless conveyor belts pass over the bore holes in the suction chamber. These conveyor belts are porous and so have a negative pressure or suction at their upper surfaces. An axial blower, which is installed at the bottom of the suction chamber, produces the necessary negative pressure in the suction chamber. A baffle, which is positioned adjustable in the suction chamber, makes it possible to separate the suction chamber into two sections of different pressure levels, with these sections being positioned subsequently in the conveying direction.

In the German published unexamined patent application No. 3138481 there is shown another single suction chamber sheet conveying device. This prior art device also uses an integrated axial blower. In this prior device, however, the negative pressure or vacuum level in the single suction chamber is not changeable with respect to the sheet conveying direction. This means that the shingled sheets which are transported by endless belts that pass over the suction chamber are sucked against the belts with a constant suction force over the entire conveying length.

A particular disadvantage of this type of conveying device is that, especially when the first sheet or sheets of a shingled stream of sheets is being conveyed, the suction openings along the entire conveying way are uncovered. So much atmospheric pressure comes into the suction chamber through these openings that there is nearly attained a pressure balance. For this reason, the suction force is nearly zero and is no longer strong enough to remove a first sheet of a sheet stream from a sheet pile in such a way that the sheet will remain in the position it should have. A suction force which would be strong enough to take a sheet from a sheet pile table in such a way that the sheet remains in the position it should have can, however, be too strong, especially for thin paper, to allow the adjustment of the sheets in the area of subsequent front lays. It is not important how the suction air of a conveying table with a single suction chamber is adjusted, big or small; there is in any case a disadvantage for the sheet transport from the sheet pile to the sheet handling machine.

The conveyor belts, which are positioned adjacent and parallel to each other, have no additional sealing material, so that there is produced a vacuum in the space between the two adjacent conveyor belts. This vacuum sucks the transported sheets not only against the conveyor belts, but also against the conveying table. This results in an unwanted braking and deformation effect between sheet and conveying table which can cause transport problems such as, for example, misalignment of the sheets.

In these prior art devices which use an axial blower to produce the negative pressure in the single suction chamber, the axial blower does not have sufficient force to create a high negative pressure level at the beginning area of the conveying path. The resulting suction force is not high enough to engage and to pull a sheet away from the sheet stack with enough force that the sheet will remain in its desired position as it is pulled from the sheet stacks.

German published unexamined patent application No. 3838078 discloses a device for conveying in particular shingled streams of sheets to a sheet handling machine. In this device there are provided two separate suction chambers which can each be provided with negative pressures of different pressure levels. These separate suction chambers are arranged subsequent to each other in the direction of sheet conveying.

One particular limitation of all of these above-described sheet conveying devices resides in the continuously running belts that are used for sheet transport. The distance between the spaced belts is apt to vary with respect to the direction of sheet transport. This variation may be due to manufacturing tolerance variations which arise from inexpert belt assembly or may arise because of unique belt wear or elongation over time. In the case in which the belts tend to converge with respect to each other in the sheet conveying direction, the sheets being conveyed will develop wrinkles or folds. These wrinkles or folds are apt to be formed in the sheets in the direction of sheet conveyance. The production of these wrinkles or folds in the sheets as they are sucked against and are transported by the conveyor belts will make it more difficult to properly align or regulate the sheets and will cause register errors during further sheet transport.

It is clear that while the general idea of the use of vacuum conveyor belts is well known for the transport of shingled stream of sheets, these prior art devices have been less than entirely satisfactory in use. The sheet conveying apparatus of the present invention, as will be discussed in detail shortly, overcomes the limitations of the above-discussed devices and is a significant improvement over the prior art.

SUMMARY OF THE INVENTION

It is an object of the present invention to provide a sheet conveying apparatus.

A further object of the present invention is to provide a device for conveying a shingled stream of sheets.

Another object of the present invention is to provide a device for conveying a shingled stream of sheets to a sheet handling machine.

Yet a further object of the present invention is to provide a sheet conveying apparatus having separate spaced suction chambers.

Still another object of the present invention is to provide a sheet conveying apparatus having adjustably positionable spaced sheet conveying belts.

Even still a further object of the present invention is to provide a sheet conveying apparatus in which the transported sheets are stretched in the direction transverse to the sheet conveying direction.

As will be discussed in greater detail in the description of the preferred embodiments which is set forth subsequently, the sheet conveying apparatus in accordance with the present invention conveys a plurality of sheets, typically in a shingled sheet stack array, from a sheet pile or other sheet supply source to a subsequent sheet handling assembly. Two spaced endless conveying belts are arranged generally parallel to each other and each travels over two serially arranged suction chambers. The negative pressure in each suction chamber is imparted to its overrunning belt. Each of the belts is positionable with respect to the other so that an amount of divergence of the belts with sheet travel away from the sheet infeed end can be varied. The level of negative pressure applied to each belt by its associated suction chambers can be controlled. Further, air compensation bore holes can be provided between the two belts to prevent the sheets from sticking to the conveying table itself.

The sheet conveying apparatus of the present invention provides for the safe, efficient transport of sheets away from a sheet pile to front register lays or the like even at high transport speeds. In contrast with prior art devices, the sheets are not wrinkled or creased during transport and are not held against the surface of the table itself.

Each sheet conveying belt passes over two separate suction chambers. The level of negative pressure in the separate suction chambers can be controlled both in the longitudinal direction of sheet travel and also transverse to the direction of sheet travel. Thus the amount of suction exerted by one belt on one side of the sheet can be different from the amount of suction exerted by the other belt on the other side of the sheet. This allows the position of the sheet to be adjusted during sheet transport either to the right or to the left in the direction of the side pull lays or at the side lays.

The provision of controls for the negative pressure levels in the successively positioned suction chambers, as well as the provision of negative pressure level adjustments for each suction chamber with respect to the other suction chambers, further enhances the adaptability of the sheet conveying apparatus. The entire assembly can be adapted or set to adjust the whole transport device with regard to the overall operating conditions.

A further advantage of the sheet conveying apparatus of the present invention resides in the provision of compensation bore holes in the conveying table adjacent the conveying belts. These compensation bore holes are at atmospheric or above atmospheric pressure. Since they are positioned generally adjacent the conveying belts, which are operating at a negative pressure, they counteract any negative pressure that may be created adjacent the conveying belts. Such a negative pressure adjacent the belts tends to pull the sheets against the stationary surface of the conveying table itself and this tends to brake the sheets. The compensation bore holes enhances the sliding motion of the sheets with respect to the table surface. Additionally, they act to limit or eliminate the possible build-up of static electric charges on the sheets.

It will thus be seen that the sheet conveying apparatus in accordance with the present invention overcomes the limitations of the prior art devices and is a substantial advance in the art.

BRIEF DESCRIPTION OF THE DRAWINGS

While the novel features of the sheet conveying apparatus in accordance with the present invention are set forth with particularity in the appended claims, a full and complete understanding of the invention may be had by referring to the detailed description of preferred embodiments which is presented subsequently, and as illustrated in the accompanying drawings, in which:

DETAILED DESCRIPTION OF PREFERRED EMBODIMENTS

Figure 1:
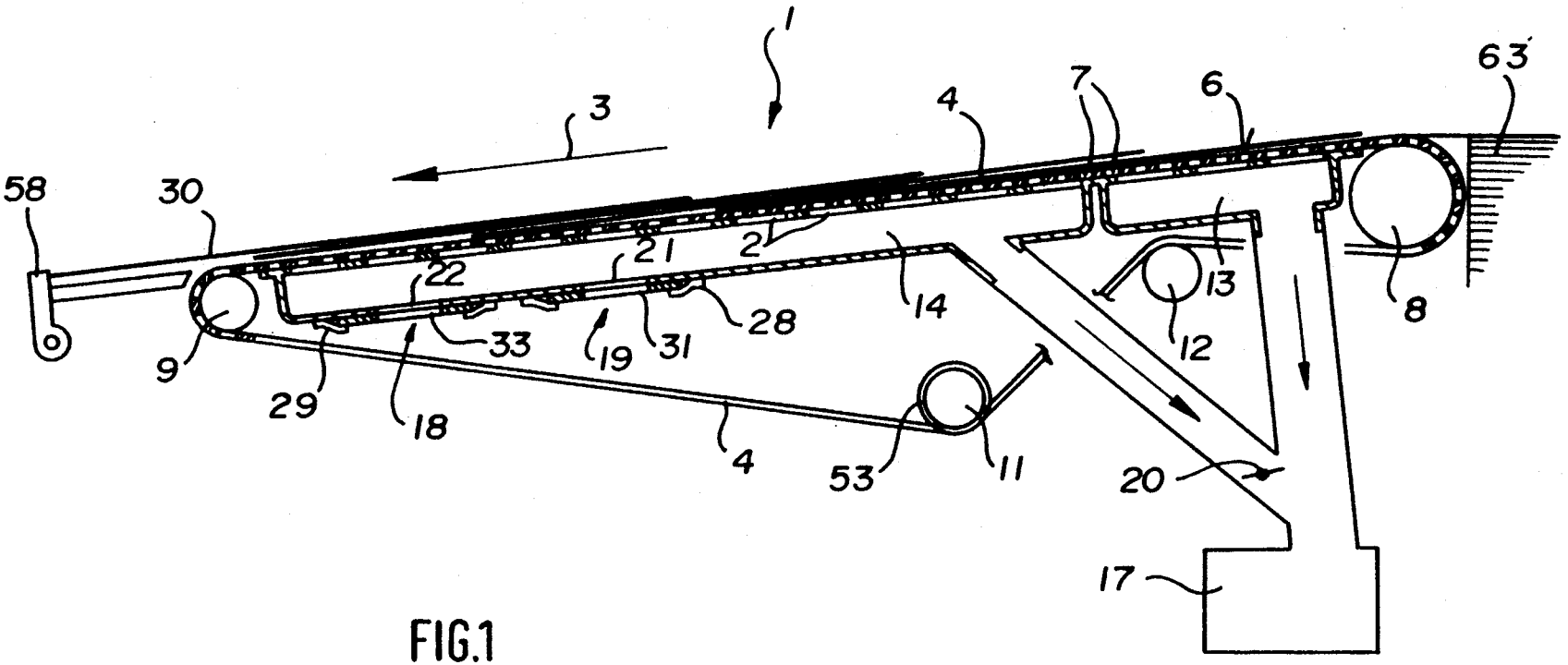
FIG. 1 is a schematic side elevation view of the sheet conveying apparatus in accordance with the present invention.

Referring initially primarily to FIG. 1, there may be seen a preferred embodiment of a sheet conveying assembly in accordance with the present invention. A sheet conveying table, generally at 1, is provided with two spaced rows of suction bore holes 2. As may be seen more clearly in FIGS. 2 and 3, these two spaced rows of suction bore holes 2 are generally parallel to each other and extend along an upper surface 6 of conveyor table 1 in two spaced rows. Each of these suction bore holes 2 may, in the preferred embodiment, have a size of generally about 35 mm.

A pair of endless or continuous conveyor belts 4 are positioned for movement with respect to the conveyor table 1 These spaced conveyor belts 4 are supported on the upper surface 6 of the conveyor table 1 for movement in a direction 3 of sheet conveyance. Each of these conveyor belts has, as may be seen in FIGS. 2 and 3, a plurality of belt perforations 7. These belt perforations 7 each have a size of generally about 8 mm. and are arranged on the endless belts 4 so that they completely overlie the spaced suction bore holes 2 in the surface 6 of the conveyor table 1.

Each of the conveyor belts 4 is supported by spaced rollers 8 and 9 which are located at either end of the table 1. The belts 4 are also guided under the conveyor table 1 by additional rollers 11 and 12. Each of these four rollers 8, 9, 11 and 12 is rotatably supported in side frames of the conveyor table 1 in a manner which is not specifically shown. Roller 8 may be provided with a suitable drive means (not shown). In addition, idler roller 11 may be provided with a suitable belt tensioning assembly that is also not specifically shown. Thus, each of the conveyor belts 4 is guided and driven in an endless path along the surface 6 of the conveyor table 1 in the sheet conveying direction 3 and is suitably tensioned.

A total of four separate suction chambers 13, 14, 15 and 16 are situated beneath the surface 6 of the conveyor table 1. The overall arrangement of these four suction chambers may best be seen in FIG. 4. Relatively short suction chambers 13 and 15 are positioned at a leading end of table and are followed by relatively elongated suction chambers 14 and 16, respectively. The top of each of these suction chambers 13, 14, 15 and 16 is formed by an overlying part of the surface 6 of the conveying table 1 so that the suction bore holes 2 in the table surface 6 enter into the suction chambers 13, 14, 15 or 16. All four of the suction chambers 13, 14, 15 and 16 are connected with a single suction source 17, which is preferably a radial blower. It is also possible to provide each of the suction chambers 13, 14, 15 and 16 With its own separate adjustable suction source 17. Other combinations of suction chambers and suction sources are also possible.

Figure 4:
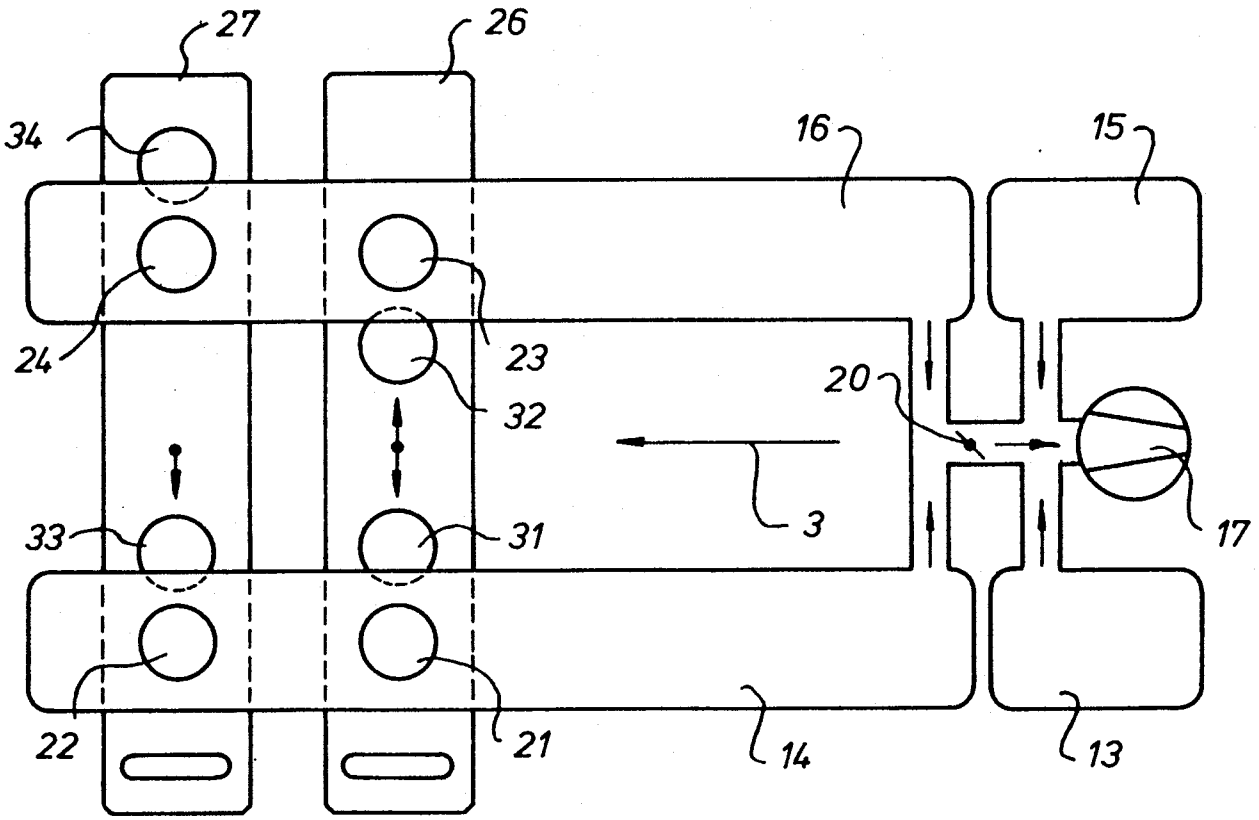
FIG. 4 is a schematic top plan view of the assembly for control of the negative pressure in the suction chambers in accordance with the present invention.

A pair of slide valve assemblies, generally at 18 and 19, are provided for the two generally elongated parallel suction chambers 14 and 16, as may be seen in FIGS. 1 and 4. In addition, the entire supply of negative air to the suction chambers 14 and 16 may be adjusted by means of an air baffle 20 which can be used to completely stop the creation of a negative pressure in suction chambers 14 and 16.

Referring now primarily to FIG. 4, each of the slide valve assemblies 18 and 19 may be seen to underlie spaced openings 22 and 24 or 21 and 23, respectively, in suction chambers 14 and 16, respectively. Openings 21 and 22 in suction chamber 14 and openings 23 and 24 in suction chamber 16 are positioned in the conveying direction with respect to each other. The openings 21 and 22 are parallel to the openings 23 and 24. Two parallel slides 26 and 27 are supported by guides 28 and 29 respectively beneath the openings 21, 23 and 22, 24, respectively, in the suction chambers 14 and 16. It can be seen in FIG. 4 that the direction of sliding motions of each of these slides 26 and 27 is generally transverse to the conveying direction 3. Each of the slides 26 and 27 is made of a suitable plastic or of sheet steel or the like and is provided with suitable handles. The slide 26 which underlies the upstream, in the conveying direction, openings 21 and 23 in the spaced suction chambers 14 and 16, is provided with two spaced air bleed openings 31 and 32. The spacing of these two bleed openings 31 and 32 in the upstream slide 26 is less than the spacing between the two openings 21 and 23 in the elongated suction chambers 14 and 16. Thus in the position shown in FIG. 4, the openings 21 and 23 in the suction chambers are closed by the slide 26. Movement of slide 26 in either direction, as indicated by the double-headed arrow on slide 26 will align either opening 21 with bleed opening 31 or opening 23 with bleed opening 32. Thus this first slide 26 is usable to vary the level of negative pressure in one elongated suction chamber with respect to the other, if necessary.

The second slide 27 has its bleed openings 33 and 34 formed so that their spacing is the same as the downstream openings 22 and 24 in the elongated suction chambers 14 and 16. The two openings 22 and 24 are closed by the slide 27 when this slide is in the position shown in FIG. 4. Movement of slide 27 in the direction indicated by the single-headed arrow shown on slide 27 will bring bleed holes 33 and 34 partially or totally into alignment with the openings 22 and 24 in suction chambers 14 and 16. When these bleed holes 33, 34 and openings 22, 24 are in such alignment, atmospheric pressure is admitted to both suction chambers 14 and 16 equally. Thus the downstream slider 27 is usable to control the negative pressure equally in both of the elongated suction chambers 14 and 16 at the same time.

In the position depicted in FIGS. 1 and 4, the supply of negative pressure to all four of the suction chambers 13, 14, 15 and 16 from the suction device 17 is the same. The upper suction openings 2 and the conveyor belt openings 7 thus exert a suction on a plurality of sheets 30 to convey a stream of sheets 30 along the upper surface 6 of the conveying table 1 in the transport direction 3.

Figure 2:
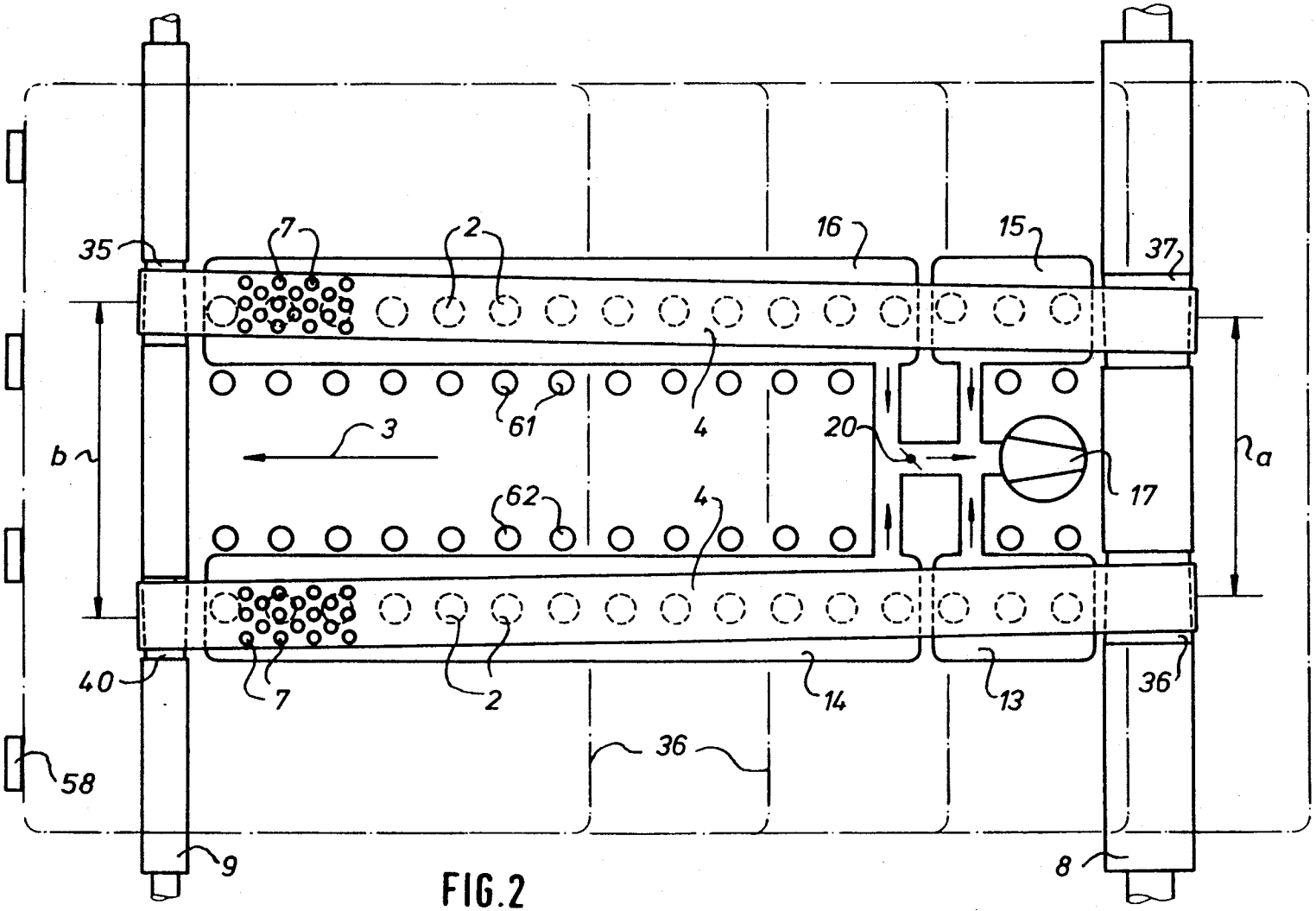
FIG. 2 is a top plan view of the present invention and showing a first preferred embodiment of a conveying belt adjustment assembly.
Figure 3:
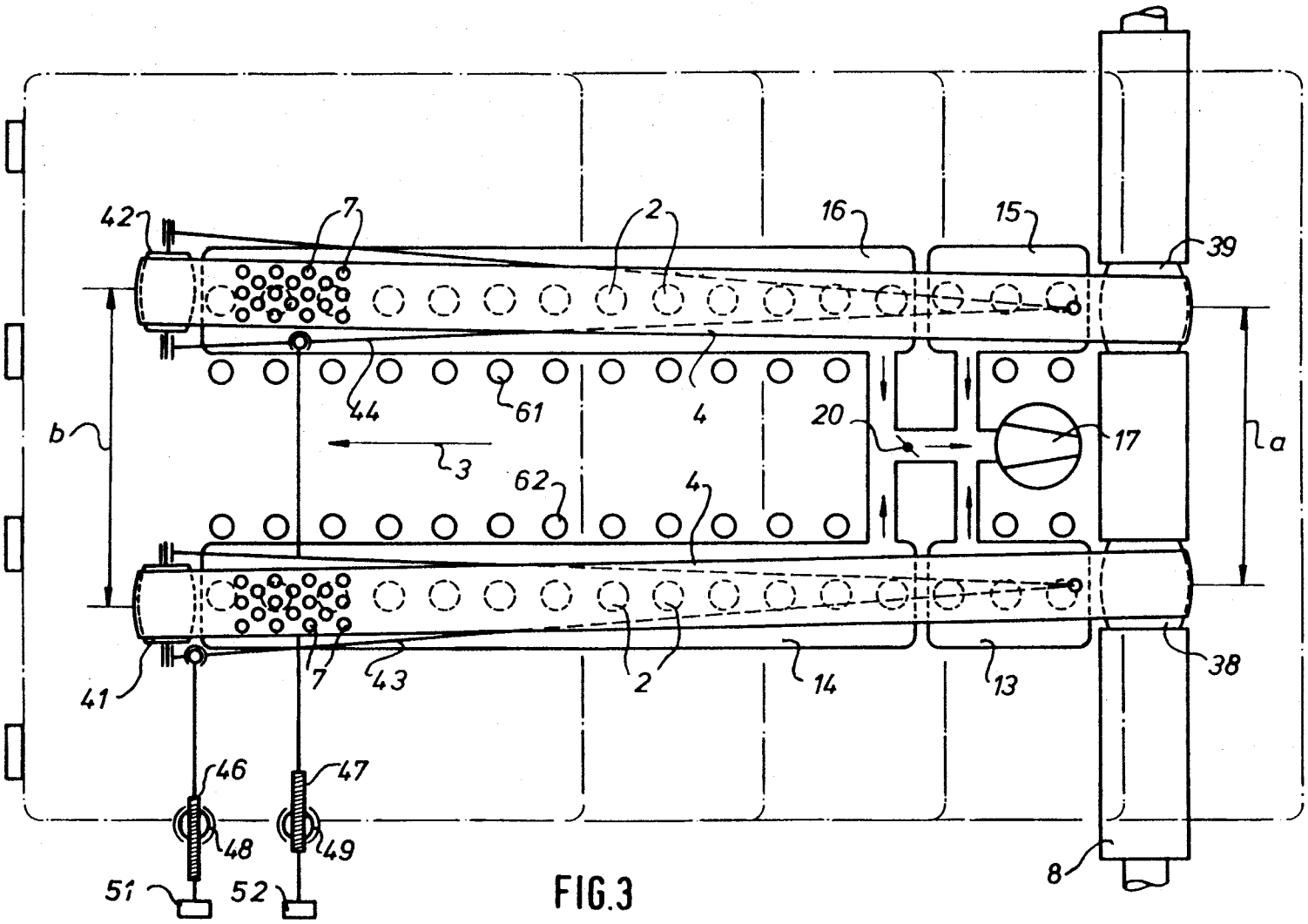
FIG. 3 is a top plan view generally similar to FIG. 2 and showing a second preferred embodiment of a conveying belt adjustment assembly.

Turning now particularly to FIGS. 2 and 3, the two embodiments of the assembly for adjusting or varying the- spacing and relative speeds of the two spaced conveying belts 4 will now be discussed. These perforated conveyor belts 4 are guided along the upper surface 6 of the table 1 in a manner such that their relative spacing can be caused to diverge to a greater or lesser amount with travel in the conveying direction 3. This means that a spacing distance "a" between the two belts 4 is smaller at the upstream or sheet stack end of the table than is the spacing distance "b" between the two belts 4 at a downstream or register lays end of the table 1. In a conveying table having a conveying path length of 1,000 mm. the divergence of each of the conveying belts 4 may be in the range of 0 to about 15 mm.

In the first embodiment which is depicted in FIG. 2, the upstream driven roller 8 is provided with spaced truncated cone-shaped belt guide recesses 36 and 37 which receive the conveyor belts 4. These shaft recesses 36 and 37 are formed so that their larger diameter portions are at the outer ends of the roller 8. This tends to cause the two belts 4 to move closer together at the upstream or infeed end of the table 1. The idler roller 9 at the downstream or outfeed end of table 1 is also provided with spaced, truncated cone-shaped belt guide recesses 35 and 40. These recesses are structured so that their larger diameter positions are toward the center of the roller 9. This tends to cause the two belts 4 to diverge toward the outer ends of the idler roller 9.

The speeds of the two conveying belts 4 can also be varied with respect to each other so that the position of misaligned sheets 30 may be adjusted. The drive roller 8 and the idler roller 9 are each axially shiftable with respect to the conveyor table 1. Further, the widths of the truncated cone belt guide surfaces 36, 37, 35 and 40 are greater than the width of the belts 4. The rollers 8 and 9 can thus be shifted to vary the position of the conveyor belts 4 on the shaft recesses 36, 37 or 35, 40. Depending on the direction of shifting, the driving diameter or circumference will be made either larger or smaller. Thus the speed of the conveying belts 4 may be varied in proportion to the change in circumference of the truncated cones. The stretching or tensioning roller 11, which may be spring biased to control the tension in the belts 4, may be provided with spaced belt guides 53, such as end washers so that the conveyor belts 4 will not drift along the surfaces of the stretching roller 11 It would be possible to have the drive roller 8 and the idler roller 9 axially fixed and to have the stretching roller 11 axially shiftable.

When the difference in spacings "a" and "b" at the upstream and downstream ends of the conveying table 1 between the belts 4 is quite small, the idler roller 9 can be a passing roller. If this is the case, the divergence of the conveying belts 4 from each other in the conveying direction 3 will be dependent only on the amount of incline of the truncated cone-shaped recesses 36 and 37 in the drive roller 8.

Turning now to the second preferred embodiment shown in FIG. 3, the adjustment of the divergence of the conveyor belts 4 is accomplished using a somewhat different structure. In this second embodiment, the drive roller 8 has spaced crowned shaft recesses 38 and 39. These recesses are generally barrel-shaped and tend to direct the belts 4 to the centers of the crown-shaped recesses 38 and 39. The single idler roller 9 of the first preferred embodiment is replaced by two individual crown-shaped rollers 41 and 42. The crowned outer surfaces of these two rollers 41 and 42 are barrel-shaped in a manner similar to that of the recesses 38 and 39 on the drive roller 8.

Each of the single rollers 41 and 42 is rotatably installed on a separate, horizontally pivotable frame 43 or 44, respectively. Each such frame 43, 44 is connected by a wrist pin to a first end of an elongated threaded rod 46 or 47. These threaded rods pass through fixed tapped holes 48 and 49. Second ends of rods 46 and 47 are provided with suitable hand wheels 51 and 52, respectively. Thus the angular orientations of the two frames 43 and 44 and hence of their supportive rollers 41 and 42 with respect to the drive roller 8 can be adjusted by rotation of the hand wheels 51 and 52. It will be understood that these hand wheels 51 and 52 could be replaced by suitable automatic operators and controllers.

Returning now to FIGS. 2 and 3, rows of compensation bore holes 61 and 62 are placed in upper surface 6 of table 1 inwardly of elongated suction chambers 16 and 14, respectively. These compensation bore holes 61 and 62 are generally parallel to the spaced rows of suction openings 2. These compensation bore holes 61 and 62 are in contact with atmospheric pressure on the underside of the table 1 and prevent the build-up of any negative pressure between the conveyor belts 4. Such a build-up of negative pressure between the belts 4 could, if it were to occur, act as a brake on the sheets 30 being conveyed by the belts 4. The compensation bore holes could, if necessary, be connected to a source of positive pressure such as compressed air taken from the positive side of the blower 17. This provision of positive pressure would act as an air cushion to assist the sliding motion of the sheets 30 with respect to the upper surface 6 of the table 1. Additional compensation bore holes 61 and 62 could also be positioned exteriorly of the path of travel of the conveyor belts 4 in the conveyor table 1.

In operation of the sheet conveying apparatus of the present invention, the sheets 30 to be conveyed are fed from a sheet pile 63 in a shingled array to the conveyor table 1, as may be seen in FIG. 1. The upstream, short suction chambers 13 and 15 are provided with a strong negative pressure so that the sheets 30 will be pulled in safety onto the perforated conveyor belts 4 and will remain in their desired position. The sheets 30 are conveyed across the upper surface 6 of the table 1 by the belts 4 toward suitable front register lays 58 that are located adjacent the downstream end of the table 1. At the same time, the sheets 30 are stretched in the direction transverse to the direction of travel 3 by the divergence of the belts 4.

The leading sheet 30 which contacts the front register lays 58 is supported on the table 1 above the elongated suction chambers 14 and 16. As was discussed above, the negative pressure level in these chambers can be lower than that in the upstream suction chambers 13 and 15. This will allow suitable side register lays that are not specifically shown to align the stretched sheets 30 through the imposition of relatively small side forces. As was previously discussed, the spaced elongated suction chambers 14 and 16 can be provided with different negative pressure levels by activation of the slider 26. If, for example, the conveyor belt 4 which overlies the suction chamber 14 is provided with a smaller suction force than is provided to the belt 4 that overlies suction chamber 16 by suitable placement of slider 26, all of the sheets 30 conveyed along the surface 6 of the conveyor table 1 will be pulled more to the side of the table which is above the higher negative pressure suction chamber 16.

Lateral stops (not shown) could be placed along the sides of the table 1 and would engage the sides of the sheets 30 as they move along the upper surface 6 of the table 1. These side lays would effect a suitable lateral alignment of the sheets 30. It would also be possible to provide laterally shingled sheet streams which could be registered by page orientation through recognizing scanning elements over the Whole sheet length.

While preferred embodiments of a sheet conveying apparatus in accordance with the present invention have been set forth fully and completely hereinabove, it will be apparent to one of skill in the art that a number of changes in, for example, the length of the conveying table, the drive means for the drive roller, the number of suction holes, the type of conveying belt and the like could be made without departing from the true spirit and scope of the invention, which is accordingly to be limited only by the following claims.

What is claimed is:

1. A sheet conveying apparatus usable to convey a shingled stream of sheets from a sheet stack to a sheet handling machine, said sheet conveying apparatus comprising:

a conveyor table having an upper sheet conveying surface extending from an upstream end to a downstream end;

at least first and second spaced, generally parallel endless perforated conveyor belts driven for motion along said upper sheet conveying surface said first and second conveyor belts being spaced rom each other at a first distance at said upstream end of said surface and at a second distance at said downstream end of said surface;

at least first and second separate suction chambers each having a negative pressure supply positioned under said conveyor table beneath said first conveyor belt and at least third and fourth separate suction chambers each having a negative pressure supply positioned under said conveyor table beneath said second conveyor belt;

a plurality of suction openings in said upper sheet conveying surface interposed between each one of said first, second, third, and fourth suction chambers and said overlying cooperating conveyor belts;

means to control said negative pressure supply to each one of said first, second, third and fourth suction chambers; and means for supporting said at least first and second conveyor belts for said motion along said upper sheet conveying surface wherein said first distance is less than said second distance to cause said at least first and second conveyor belts to diverge from each other in a sheet conveying direction during conveyance of said shingled stream of sheets on said upper sheet conveying surface of said conveyor table.

2. The sheet conveying apparatus of claim 1 wherein said conveyor belt supporting means includes a drive roller having first and second spaced converging truncated cone-shaped supporting recesses for supporting said first and second spaced conveyor belts at said upstream end of said sheet conveying surface and an idler roller having first and second spaced diverging truncated cone-shaped supporting recesses for supporting said first and second spaced conveyor belts at said downstream end of said sheet conveying surface.

3. The sheet conveying apparatus of claim 1 further including means for adjusting an amount which said at least first and second conveyor belts are caused to diverge from each other.

4. The sheet conveying apparatus of claim 3 wherein said adjusting means includes a drive roller having spaced, generally barrel-shaped supporting recesses for supporting said first and second spaced conveyor belts at said upstream end of said sheet conveying surface and a separate horizontally pivotable barrel-shaped roller for each said first and second conveyor belt at said downstream end of said sheet conveying surface.

5. The sheet conveying apparatus of claim 1 wherein said negative pressure supply control means includes a slide valve and an air baffle.

6. The sheet conveying apparatus of claim 1 further including air compensation bore holes on said upper sheet conveying surface of said conveyor table.

7. The sheet conveying apparatus of claim 6 further including providing said air compensation bore holes on both sides of said at least first and second conveyor belts.

8. The sheet conveying apparatus of claim 2 including a stretching roller having side guides, said at least first and second spaced conveyor belts also being supported by said stretching roller and further wherein said truncated cone-shaped conveyor belt supporting recesses on said drive roller and said idler roller each have a width greater than the width of said first or second conveyor belt being supported thereby.

* * * * *